US005543065A

United States Patent [19]

Mudge

[11] Patent Number: 5,543,065

[45] Date of Patent: Aug. 6, 1996

[54] SMOKE REDUCTION OF FIBER LUBRICANTS

[75] Inventor: Elbert H. Mudge, Charlotte, N.C.

[73] Assignee: Henkel Corporation, Plymouth Meeting, Pa.

[21] Appl. No.: 473,152

[22] Filed: Jun. 7, 1995

[51] Int. Cl.[6] ..... D06M 13/10

[52] U.S. Cl. ..... 252/8.84; 427/394; 8/115.6; 252/8.85; 252/8.86; 252/8.81

[58] Field of Search ..... 252/8.6, 8.8, 8.7, 252/8.75; 427/384, 394; 8/115.6

[56] References Cited

U.S. PATENT DOCUMENTS

| | | | |
|---|---|---|---|
| 3,146,272 | 8/1964 | Lloyd | 568/582 |
| 3,505,220 | 4/1970 | Blake et al. | 252/8.6 |
| 4,217,228 | 8/1980 | Koerner et al. | 252/8.6 |
| 4,469,606 | 9/1984 | Reid et al. | 252/8.8 |
| 5,155,244 | 10/1992 | Greene et al. | 554/2 |
| 5,240,743 | 8/1993 | Tuller et al. | 252/8.6 |
| 5,314,718 | 5/1994 | Tuller et al. | 252/8.6 |

*Primary Examiner*—Anthony Green
*Attorney, Agent, or Firm*—Ernest G. Szoke; Wayne C. Jaeschke; Real J. Grandmaison

[57] ABSTRACT

A composition and process for reducing the amount of smoke generated at elevated temperatures when applying a fiber finish composition to fibers. The addition of certain antioxidants to a fiber lubricant composition containing oxa-acids or oxa-acid esters substantially reduces the development of smoke at temperatures from 170° C. to 200° C.

13 Claims, 1 Drawing Sheet

SMOKE REDUCTION OF FIBER LUBRICANTS

BACKGROUND OF THE INVENTION

1. Field of the Invention

This invention relates to the field of fiber finishes, and more particularly, to fiber lubricants containing an antioxidant which reduces the generation of visible smoke at elevated temperatures.

Fiber lubricants are commonly used as a fiber finish. When so employed, fiber lubricants must protect newly spun fibers from fusion or breakage by controlling the yarn-to-metal friction between the yarn and machine guides, rollers, draw plates, beater plates and texturing twist spindles or friction disks. The lubricant also provides for yarn cohesion thus strengthening the yarn by holding the yarn bundle together and allowing the yarn to build up to a suitable bundle at the end of processing. Static electricity that would normally be formed as the yarn moves rapidly through processing equipment is also controlled to a great extent. In addition, the lubricant protects equipment surfaces from wear and tear. Further, since the yarn or fiber is exposed to subsequent heat treatment at elevated temperatures, the lubricant must be thermally stable.

Thus, the afore-mentioned properties of the fiber lubricant are desirably not lost when the lubricated fiber is exposed to elevated temperatures such as about 200° C., i.e., through degradation or volatilization of the lubricant. Prior art lubricants applied to synthetic textile fibers generally suffer from the deficiency that at temperatures above 170° C. they generate smoke indicating volatilization or form a tarry residue. Such tarry residue may likely deposit on heated metal surfaces thus contaminating the processing equipment and/or the fiber. In addition, when smoke is generated excessively, such results in health and safety hazards.

DISCUSSION OF RELATED ART

In the past, different types of thermal and oxidation stabilizers have been used with fiber finishes in an effort to overcome the afore-noted drawbacks, but with only limited degrees of success. For example, phenols, aryl sulfonamides and phenothiazines have been employed but have been found to cause discoloration of the finish. More particularly, 4,4'-thiobis (6-tert. butyl- 3-methylphenol), commercially available under the tradename SANTONOX R® from Monsanto Chemical Co. has been widely used as a thermal stabilizer for industrial fiber finishes. However, it has been found to possess poor resistance to gas fade induced discoloration. In addition, U.S. Pat. No. 3,146,272 proposes the use of alkylene oxide condensation products as antioxidants in fiber finishes. Also, U.S. Pat. No. 3,397,081 discloses textile lubricants containing the reaction product of diphenylamine and acetone as an antioxidant. U.S. Pat. No. 3,505,220 teaches phenolic antioxidants for use in mineral oil-polybutene finishing compositions. U.S. Pat. No. 4,217,228 relates to fiber finishes containing aryloxy-substituted silicone oil thermal stabilizers. Lastly, U.S. Pat. No. 4,469,606 discloses a fiber finish composition containing a blend of a substituted 1,3,5-triazine and a multi-functional hindered phenolic compound.

DESCRIPTION OF THE INVENTION

Figure 1:
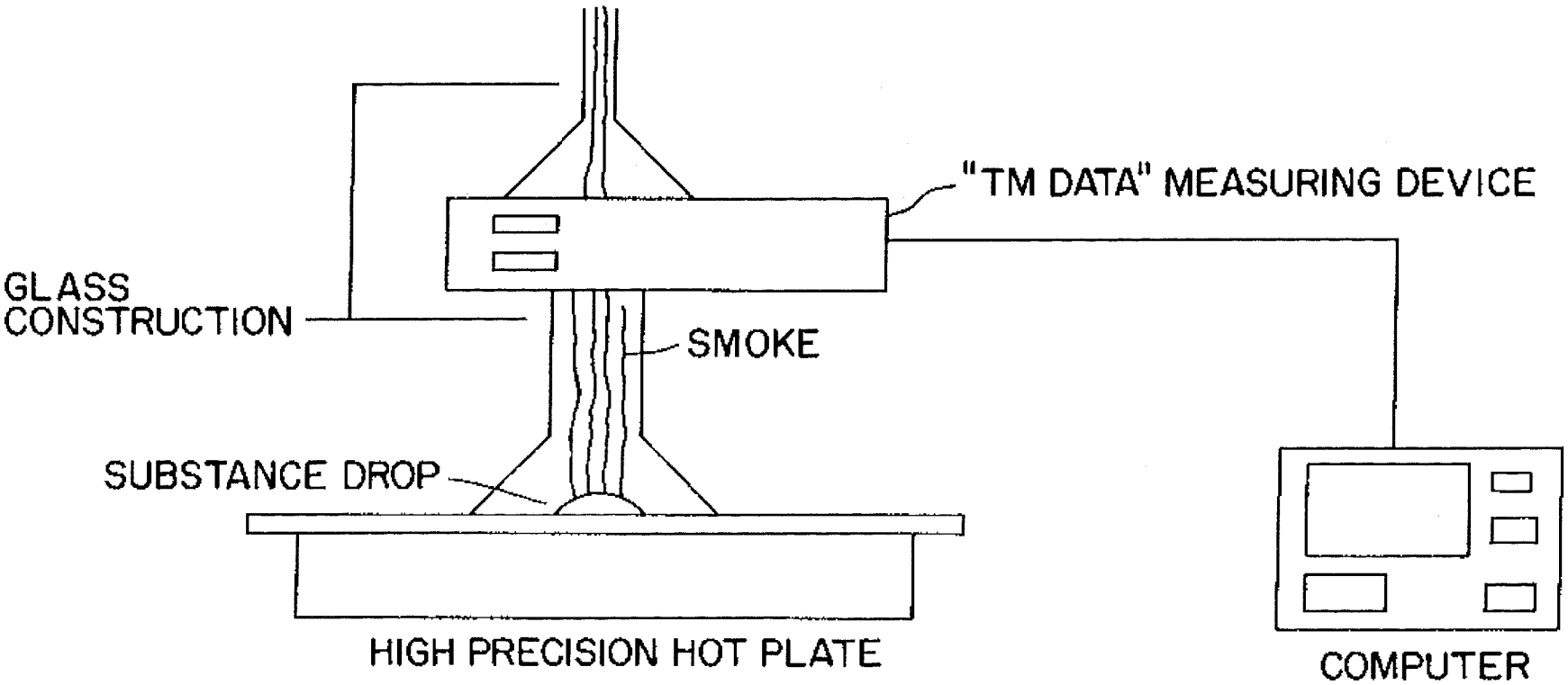
FIG. 1 shows a smoke measurement device known as the "Hund-Gerät" tester.

Other than in the operating examples, or where otherwise indicated, all numbers expressing quantities of ingredients or reaction conditions used herein are to be understood as modified in all instances by the term "about".

It has now been found that certain antioxidants substantially reduce the volume of visible smoke generated from fiber lubricant compositions exposed to elevated temperatures such as from 170° C. to 200° C. More specifically, it has been found that the volume of visible smoke is substantially reduced when employing fiber lubricant compositions containing an antioxidant selected from the group consisting of tris (4-t-butyl-3-hydroxy-2,6-dimethylbenzyl)-s-triazine-2,4,6-(1H,3H, 5H)-trione; ditridecylthiodipropionate; thiodiethylene bis (3,5-di-tert-butyl-4-hydroxy)-hydrocinnamate; tetrakis[methylene (3,5-di-tert-butyl-4-hydroxy-hydrocinnamate)] methane; and tri (mixed mono-dinonyl) phenyl phosphite with or without triisopropanolamine. Tris (4-t-butyl-3-hydroxy-2,6-dimethylbenzyl)-s-triazine-2,4,6-(1H, 3H,5H)-trione is commercially available under the tradename CYANOX® 1790 from American Cyanamid Co. Ditridecylthiodipropionate is commercially available under the tradename CYANOX® 711 from American Cyanamid Co. Thiodiethylene bis (3,5-di-tert-butyl-4-hydroxyl)-hydrocinnamate is commercially available under the tradename IRGANOX® 1035 from Ciba-Geigy. Tetrakis-[methylene (3,5-di-tert-butyl-4-hydroxyhydrocinnamate)] methane is commercially available under the tradename IRGANOX® 1010 from Ciba-Geigy. Tri (mixed mono-dinonyl) phenyl phosphite is commercially available under the tradename POLYGARD® from Uniroyal, and Polygard with tri-isopropanol amine is commercially available under the tradename POLYGRAD® HR from Uniroyal.

The fiber lubricant composition is preferably selected from the group consisting of oxa-acids and oxa-acid esters having the general structural formula I $$R_1-Y-(X)_n-(CH_2)_m-\overset{\overset{\displaystyle O}{\|}}{C}-O-R_2 \qquad (I)$$

wherein $R_1$ is cyclic, straight, or branched chain alkyl, saturated or unsaturated, containing from 1 to 23 carbon atoms, n is a number from 1 to 5, m is a number from 1 to 6, Y is —O— or —S—, X is $—C_2H_4O—$ or $—C_3H_6O—$, or a mixture of $—C_2H_4O—$ and $—C_3H_6O—$, and $R_2$ is cyclic, straight, or branched chain alkyl, saturated or unsaturated, containing from 1 to 23 carbon atoms. In a preferred embodiment, $R_1$ is a mixture comprising about 70% by weight $C_8$–$C_{10}$ alkyl groups and about 30% by weight $C_{16}$–$C_{18}$ alkyl groups, and $R_2$ is a methyl group.

In addition, the fiber lubricant composition may also include pentaerythritol caprylate/caprate.

It has been found that the fiber finish compositions of this invention substantially reduce the amount of smoke generated at fiber processing temperatures resulting in less hazardous conditions to chemical operators, retention of more fiber finish composition on the processed fiber, and reduced equipment maintenance costs. In addition the antioxidants are soluble in the fiber finish compositions thus facilitating processing and stability.

In order to reduce the volume of smoke generated by the fiber lubricant composition at elevated temperatures such as from 170° C. to 200° C., the antioxidants are added to the fiber finish composition in concentrations ranging from about 0.25% to about 3.0% by weight, and preferably in a concentration range of from about 0.5% to about 1.0% by weight, based on the weight of the fiber finish composition.

The mixture of fiber finish composition and antioxidant can be prepared by blending the components together in any suitable mixing equipment. Moderate heating may be employed in order to obtain a uniform mixture. Optional ingredients may be added to the fiber finish mixture such as antistatic agents, bactericides, friction modifiers, emulsifiers, buffering agents and the like. The fiber finish mixtures may be applied to a wide variety of natural and synthetic fibers including wool, cotton, polyester, polyamide, polyolefin, acrylic, and the like.

Use of the smoke-stabilized fiber finish compositions can be in any conventional fiber or yarn treatment process such as spin-drawing or in a separate drawing process known in the art. The treatment of the fibers or yarns with the fiber finish or lubricant compositions can be effected by any method practiced in the prior art to provide lubrication such as immersion, roll application, wicking, spraying, and the like. The fiber treating composition of this invention is applied to the yarn or fibers either directly or as an aqueous emulsion having a concentration of from about 4 to about 20% by weight of the treating composition. Adequate lubricity is provided with a dry weight addition to the fibers of the treating lubricant composition of from about 0.2% to about 1.8% by weight, based on the weight of the fibers. The temperature at which the fibers are treated usually ranges from 150° C. to 220° C., and more generally from 170° C. to 200° C. The fiber treating composition of this invention provides excellent lubrication and resistance to development of visible smoke over the temperature range of about 175° C. to about 210° C.

The following examples illustrate the preferred embodiments of this invention, but should not be construed as limitations thereof. In the examples, all parts given are parts by weight unless otherwise indicated.

EXAMPLE I

This example illustrates the smoke-reducing effectiveness of fiber finish compositions containing the antioxidants in accordance with this invention. The antioxidants listed in Table 1 were added in the indicated weight concentrations to an oxa-acid ester fiber finish lubricant composition having the structural formula I $$R_1-Y-(X)_n-(CH_2)_m-\overset{\overset{\displaystyle O}{\|}}{C}-O-R_2 \qquad (I)$$

wherein $R_1$ is cyclic, straight, or branched chain alkyl, saturated or unsaturated, containing from 1 to 23 carbon atoms, n is a number from 1 to 5, m is a number from 1 to 6, Y is —O— or —S—, X is $—C_2H_4O—$ or $—C_3H_6O—$, or a mixture of $—C_2H_4O—$ and $—C_3H_6O—$, and $R_2$ is cyclic, straight, or branched chain alkyl, saturated or unsaturated, containing from 1 to 23 carbon atoms. In order to evaluate the smoke reduction characteristics of the resulting mixtures, the following test method was employed. Smoking tendency of the mixtures was measured at 160° C., 170° C., 180° C. and 190° C. using a smoke measurement device known as the "Hund-Gerät" tester, as is shown in FIG. 1. This instrument operates in accordance with the principle of scattered light measurement with a uniform resolution of 0.01 over the entire range of 0.01 to 99.99 intensity units and detects respirable fine dust without pre-filtrations of coarse particles.

The special design of the scattered light measuring unit (primary light wave-length=940 nm, measurement angle=70°) assures measurement of the fraction of respirable particles of the entire airborne dust.

The optical response curve resulting from the above specified selection of primary light and scattered angle does, admittedly, deviate from the definition curve for dust, but provides close linear correlations of the measured values of scattered light photometers with gravimetric respirable dust measuring instruments. Conversion factors have to be considered for or determined between the optical and gravimetric measuring instruments owing to the differences in the assessment curves. These conversion factors essentially depend upon the size distribution of the airborne dust. Other dust characteristics have little influence.

The conversion factor is determined by conducting comparison measurements at the same time and at the same location with a gravimetric respirable dust measuring instrument.

The values in Table 1 are given as a percentage of the fiber finish and antioxidant mixture that was measured as smoke at the indicated temperatures.

TABLE 1

| Test | Anti-oxidant | %/wt | 160° C. | 170° C. | 180° C. | 190° C. |
|---|---|---|---|---|---|---|
| 1 | none | 0 | 6.2 | 10.3 | 54.1 | N.M.* |
| 2 | CYANOX ® 1790 | 0.5 | 5.3 | 9.5 | 37.1 | 49.1 |
| 3 | CYANOX ® 1790 | 1.0 | 7.3 | 15.4 | 29.0 | 47.1 |
| 4 | CYANOX ® 711 | 0.5 | 7.5 | 15.3 | 51.7 | N.M. |
| 5 | CYANOX ® 711 | 1.0 | 6.9 | 8.5 | 42.3 | N.M. |
| 6 | CYANOX ® 1790 + CYANOX ® 711 | 0.25 0.25 | 5.8 | 13.0 | 27.0 | 63.0 |
| 7 | CYANOX ® 1790 + CYANOX ® 711 | 0.5 0.5 | 5.6 | 11.3 | 27.1 | 56.3 |
| 8 | IRGANOX ® 1035 | 0.5 | 7.1 | 13.1 | 29.6 | 54.6 |
| 9 | IRGANOX ® 1010 | 0.5 | 6.6 | 13.0 | 28.2 | 45.8 |
| 10 | POLYGARD ® HR | 1.0 | 6.4 | 8.7 | 30.3 | 62.6 |
| 11 | POLYGARD ® HR + CYANOX ® 1790 + CYANOX ® 711 | 0.2 0.4 | 5.2 | 10.7 | 30.8 | N.M. |
| 12 | CYANOX ® 1790 + CYANOX ® 711 | 0.75 0.75 | 4.0 | 13.3 | 25.9 | 51.7 |
| 13 | SF 7276 6 | 0.00 | 6.1 | 10.2 | 46.2 | N.M. |

TABLE 1-continued

| Test | Anti-oxidant | %/wt | 160° C. | 170° C. | 180° C. | 190° C. |
|---|---|---|---|---|---|---|
| 14 | CYANOX ® 1790 + CYANOX ® 711 | 0.5 0.5 | 4.3 | 7.9 | 19.1 | 36.9 |

*N.M. stands for not measurable.
*Test Samples 1–12 are 70/30 blends of $C_{8-10}/C_{16-18}$ alcohols.
*Test Samples 13 and 14 are 60/40 blends of $C_{8-10}/C_{16-18}$ alcohols.

The results show that at a temperature of 180° C., Test Samples 2, 3 and 5–12 exhibited lower smoking than the control, i.e. Test Sample 1, with the addition of the antioxidant. At 190° C., Test Samples 2, 3, 6–10 and 12 exhibited lower smoking than the control with the addition of the anti-oxidant. It can be seen in Examples 13 and 14 that a slight increase in the molecular weight of the $C_{8-10}/C_{16-18}$ alcohols by varying the weight percent of the blend from 70/30 to 60/40, results in a reduction in smoke at 180° C., but not at 190° C. Moreover, by combining this increase in molecular weight with the addition of antioxidants, as is evidenced by Test Samples 13 and 14, the lowest amount of smoke is produced.

Table II lists test data obtained after testing fiber finish composition BK-2104. Viscosity and smoke propensity were measured for fiber finish composition of BK-2104 both with and without an antioxidant component.

TABLE II

| Product Composition | Viscosity at 25° C. in mm ²/s | Smoke Propensity Hund Method |
|---|---|---|
| BK 2104 deo | 52.3 | 4.0%/200° C. |
| BK 2104 deo + 2.0% Mark 2140 + 0.5% CYANOX ® 1790 | 55.4 | 2.7%/200° C. |

*BX 2104 deo = pentaerythritol caprylate/caprate
*Mark 2140 = pentaerythritol octyl thiopropionate It is seen that the combination of the afore-mentioned fiber finish lubricant compositions with antioxidants provides significantly improved smoke reduction in such fiber finishes, as is evidenced by the reduction in smoke propensity at the disclosed elevated temperatures.

What is claimed is:

1. A fiber treating composition consisting of (A) a lubricant selected from the group consisting of oxa-acids and oxa-acid esters having the general structural formula I $$R_1-Y-(X)_n-(CH_2)_m-\overset{\overset{\displaystyle O}{\|}}{C}-O-R_2 \qquad (I)$$

wherein $R_1$ is cyclic, straight, or branched chain alkyl, saturated or unsaturated, containing from 1 to 23 carbon atoms, n is a number from 1 to 5, m is a number from 1 to 6, Y is —O— or —S—, X is $—C_2H_4O—$ or $—C_3H_6O—$, or a mixture of $—C_2H_4O—$ and $—C_3H_6O—$, and $R_2$ is cyclic, straight, or branched chain alkyl, saturated or unsaturated, containing from 1 to 23 carbon atoms, and (B) an effective smoke-reducing amount of at least one antioxidant selected from the group consisting of tris(4-t-butyl-3-hydroxy-2,6-dimethylbenzyl)-s-triazine-2,4,6-(1H,3H,5H)-trione; Ditridecylthiodipropionate; thiodiethylene bis (3,5-di-tert-butyl-4-hydroxy)-hydrocinnamate; tetrakis (methylene (3,5-di-tert-butyl-4-hydroxy-hydrocinnamate)) methane; tri phenyl phosphite; tri phenyl phosphite containing triisopropanolamine, and mixtures thereof.

2. The fiber treating composition of claim 1 wherein $R_1$ is a mixture comprising about 70% by weight $C_8$–$C_{10}$ alkyl groups and about 30% by weight of $C_{16}$–$C_{18}$ alkyl groups and $R_2$ is a methyl group.

3. The fiber treating composition of claim 1 wherein n is an integer equal to 5.

4. The fiber treating composition of claim 1 wherein said antioxidant is present in an amount of from about 0.25 to about 3.0% by weight, based on the weight of said treating composition.

5. The process of reducing the amount of visible smoke generated during the processing of fibers with a fiber finish, comprising contacting said fibers with a fiber treating composition consisting of (A) a lubricant selected from the group consisting of oxa-acids and oxa-acid esters having the general structural formula I $$R_1-Y-(X)_n-(CH_2)_m-\overset{\overset{\displaystyle O}{\|}}{C}-O-R_2 \qquad (I)$$

wherein $R_1$ is cyclic, straight, or branched chain alkyl, saturated or unsaturated, containing from 1 to 23 carbon atoms, n is a number from 1 to 5, m is a number from 1 to 6, Y is —O— or —S—, X is $—C_2H_4O—$ or $—C_3H_6O—$ or a mixture of $—C_2H_4O—$, and $—C_3H_6O—$, $R_2$ is cyclic, straight, or branched chain alkyl, saturated or unsaturated, containing from 1 to 23 carbon atoms, and (B) an effective smoke-reducing amount of at least one antioxidant selected from the group consisting of tris (4-t-butyl-3-hydroxy-2,6-dimethylbenzyl)-s-triazine-2, 4,6-(1H,3H,5H)-trione; ditridecylthiodipropionate; thiodiethylene bis (3,5-di-tert-butyl-4-hydroxy)-hydrocinnamate; tetrakis (methylene (3,5-di-tert-butyl-4-hydroxy-hydrocinnamate)) methane; tri phenyl phosphite; tri phenyl phosphite containing triisopropanolamine, and mixtures thereof.

6. The process of claim 5 wherein R is a mixture comprising about 70% by weight $C_8$–$C_{10}$ alkyl groups and about 30% by weight of $C_{16}$–$C_{18}$ alkyl groups and $R_2$ is a methyl group.

7. The process of claim 5 wherein n is an integer equal to 5.

8. The process of claim 5 wherein said antioxidant is present in an amount of from about 0.25 to about 3.0% by weight, based on the weight of said treating composition.

9. The process of claim 5 wherein said fibers are contacted with said fiber treating composition at a temperature of from about 170° C. to about 200° C.

10. The process of claim 5 wherein said fibers are selected from the group consisting of natural fibers and synthetic fibers.

11. The process of claim 10 wherein said fibers are selected from the group consisting of wool, cotton, polyester, polyamide, polyolefin, acrylic, and mixtures thereof.

12. The process of claim 5 wherein said fiber treating composition is applied to said fibers as an aqueous emulsion having a concentration of from about 4 to about 20% by weight.

13. The process of claim 5 wherein said fiber treating composition is applied to said fibers in an amount of from about 0.2% by weight to about 1.8% by weight, based on the weight of said fibers.

* * * * *

UNITED STATES PATENT AND TRADEMARK OFFICE

CERTIFICATE OF CORRECTION

PATENT NO. : 5,543,065

DATED : Aug. 6, 1996

INVENTOR(S) : Elbert H. Mudge

It is certified that error appears in the above-indentified patent and that said Letters Patent is hereby corrected as shown below:

In Col. 4, Table 1, Test 11, the %/wt of CYANOX (Registered) 711 should read --0.4--.

Signed and Sealed this

Twenty-first Day of April, 1998

Bruce Lehman

*Attest:*

BRUCE LEHMAN

*Attesting Officer*

*Commissioner of Patents and Trademarks*